US006741153B1

(12) United States Patent
Lee et al.

(10) Patent No.: US 6,741,153 B1
(45) Date of Patent: May 25, 2004

(54) FLAT HIGH-VOLTAGE IMPULSE TRANSFORMER

(75) Inventors: Li-Ling Lee, Hsinchu (TW); Ming-Chun Sung, Hsinchu (TW); Hwei-Shoung Chun, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 0 days.

(21) Appl. No.: 10/330,215

(22) Filed: Dec. 30, 2002

(51) Int. Cl.[7] ..... H01F 38/20
(52) U.S. Cl. ..... 336/174; 336/175
(58) Field of Search ..... 336/174, 175, 336/173

(56) References Cited

U.S. PATENT DOCUMENTS 5,767,759 A * 6/1998 Rouet ..... 336/174
5,805,042 A * 9/1998 Chastain et al. ..... 336/170
5,815,060 A * 9/1998 Matsumoto et al. ..... 336/175

* cited by examiner

*Primary Examiner*—Anh Mai
(74) *Attorney, Agent, or Firm*—Birch, Stewart, Kolasch & Birch, LLP

(57) ABSTRACT

A flat high-voltage impulse transformer is proposed, which can be used in conjunction with a high-intensity discharge (HID) lamp to provide a high-magnitude pulsed voltage to ignite the HID lamp. The proposed transformer structure is characterized by the use of an elongated magnetic core that is made of a magnetic material having a substantially square hysteresis loop and whose saturated flux density is at least two times greater than ferrite, and the primary winding is arranged at the middle section of the elongated magnetic core while the secondary winding is arranged at opposite sides of the primary winding on the elongated magnetic core. This feature allows the transformer of the invention to provide a better voltage transforming effect, and also allows the transformer of the invention to be made more flatted in profile to provide a compact size.

8 Claims, 3 Drawing Sheets

FLAT HIGH-VOLTAGE IMPULSE TRANSFORMER

BACKGROUND OF THE INVENTION

1. Field of the Invention

This invention relates to transformer technology, and more particularly, to a flat high-voltage impulse transformer, which can be used in conjunction with a high-intensity discharge (HID) lamp to provide a high-magnitude pulsed voltage for use to ignite the HID lamp.

2. Description of Related Art

High-intensity discharge (HID) lamp is an advanced type of high-quality lighting equipment that can produce high quality light for interior lighting purpose. In application, an HID lamp should be coupled to a transformer-based ignitor that is capable of generating a high-magnitude pulsed voltage, typically several thousands of volts, so as to be able to ignite the HID lamp. In the HID lamp ignitor, the key component is high-voltage impulse transformer.

Conventional high-voltage impulse transformers, however, have some drawbacks. First, conventional high-voltage impulse transformers are typically bulky in size, which make them incompliant with compactness requirement. Second, the pulsed voltages generated by conventional transformers are still unsatisfactory to ignite HID lamps quickly and effectively, and therefore there is still a need for a new high-voltage impulse transformer that can provide a more effective pulsed voltage to ignite the HID lamp.

SUMMARY OF THE INVENTION

It is therefore an objective of this invention to provide a flat high-voltage impulse transformer which can be made flat in profile to make it more compact in size than prior art.

It is another objective of this invention to provide a flat high-voltage impulse transformer which is capable of generating a more effective pulsed voltage output that can ignite the HID lamp more quickly and effectively than prior art.

The flat high-voltage impulse transformer according to the invention is characterized by the use of an elongated magnetic core that is made of a magnetic material having a substantially square hysteresis loop and whose saturated flux density is at least two times greater than ferrite, and the primary winding is arranged at the middle section of the elongated magnetic core while the secondary winding is arranged at opposite sides of the primary winding on the elongated magnetic core. This feature allows the transformer of the invention to provide a better voltage transforming effect, and also allows the transformer of the invention to be made more flatted in profile to provide a compact size.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

The flat high-voltage impulse transformer according to the invention is disclosed in full details by way of preferred embodiments in the following with reference to the accompanying drawings.

Figure 1:
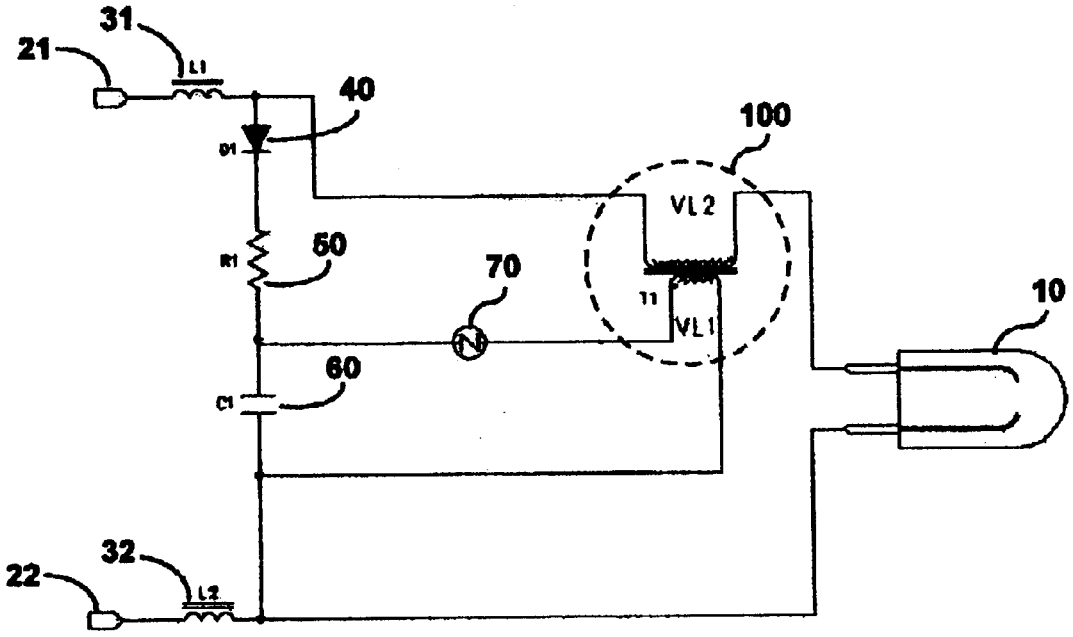
FIG. 1 is a circuit diagram showing the coupling of the transformer of the invention to a HID lamp ignitor.

FIG. 1 is a circuit diagram showing the coupling of the transformer of the invention (indicated by the reference numeral 100) to a high-intensity discharge (HID) lamp 10. As shown, in addition to the transformer of the invention 100, the ignitor for the HID lamp 10 further includes a pair of pulsed voltage sources ($V_A$, $V_B$) 21, 22, a pair of inductors (L1, L2) 31,32, a diode (D1) 40, a resistor (R1) 50, a capacitor (C1) 60, and an avalanche diode 70. This HID lamp ignitor operates in such a manner that when the potential drop $V_c$ across the capacitor (C1) 60 exceeds the breakdown voltage $V_d$ of the avalanche diode 70, it will turn the avalanche diode 70 into conductive state, thereby allowing electrical current to flow through the avalanche diode 70 to the input side of the transformer of the invention 100, resulting in a low voltage input VL1 to the primary winding of the transformer of the invention 100. The low voltage input VL1 will be then transformed by the transformer of the invention 100 into a high voltage output VL2 which is used to ignite the HID lamp 10.

Figure 2:
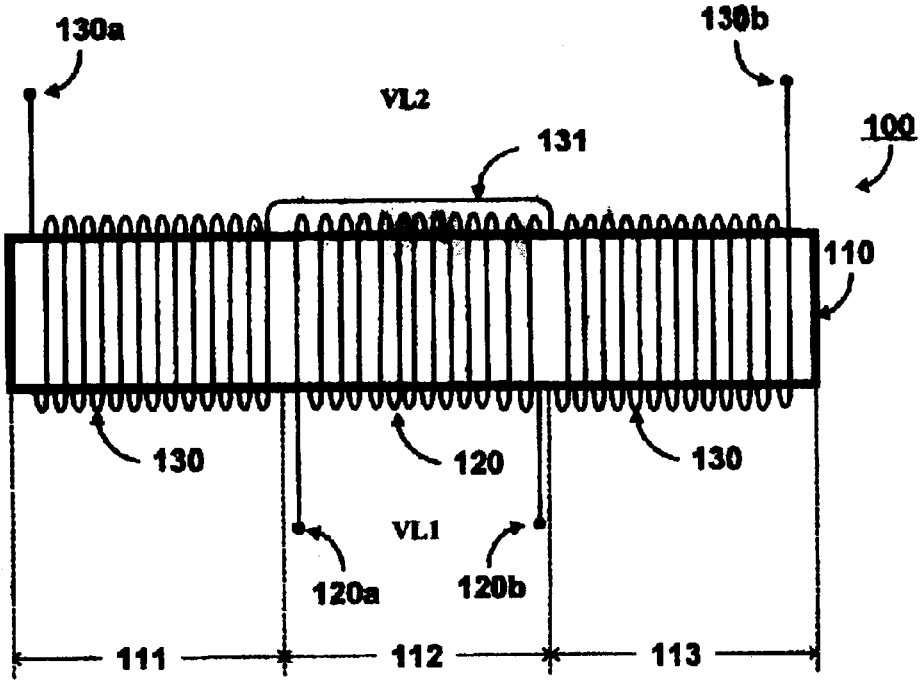
FIG. 2 is a schematic diagram illustrating the construction of the transformer of the invention.

FIG. 2 is a schematic diagram illustrating the construction of the transformer of the invention 100. As shown, the transformer of the invention 100 comprises :(a) an elongated magnetic core 110; (b) a first coil 120 for primary winding; and (c) a second coil 130 for secondary winding.

Figure 3A:
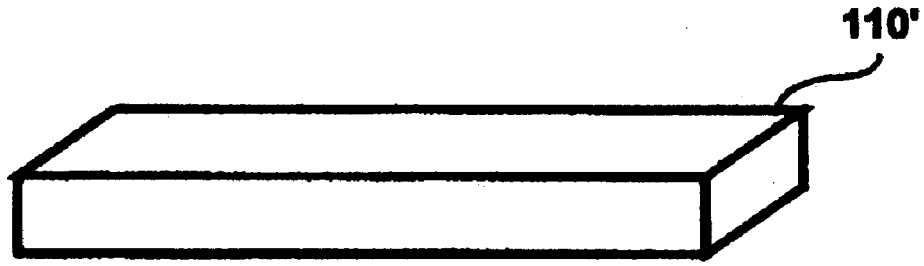
FIG. 3A is a schematic diagram showing a perspective view of a rectangularly-shaped magnetic bar utilized as the magnetic core in the transformer of the invention.
Figure 3B:
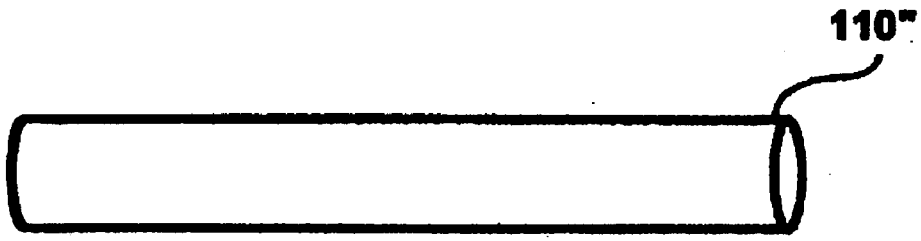
FIG. 3B is a schematic diagram showing a perspective view of a cylindrically-shaped magnetic bar utilized as the magnetic core in the transformer of the invention.

The elongated magnetic core 110 is made of a magnetic material having a substantially squarely-shaped hysteresis loop and whose saturated flux density should be at least two times greater than ferrite. Usable magnetic materials for making this elongated magnetic core 110 include, for example, silicon steel, nickel steel, cobalt-ferrite alloy, amorphous alloy, and so on. Moreover, the elongated magnetic core 110 should be formed in an elongated shape, such as the rectangularly-shaped magnetic bar 110' shown in FIG. 3A, or the cylindricaily-shaped magnetic bar 110" shown in FIG. 3B. Fundamentally, the elongated magnetic core 110 should be lengthy enough to provide three sections for windings: a first side section 111, a middle section 112, and a second side section 113.

The first coil 120 is wound around the middle section 112 of the elongated magnetic core 110, and whose two terminals 120*a*, 120*b* are arranged on opposite ends of the middle section 112. In this embodiment of the invention, the first coil 120 is used as the primary winding of the transformer of the invention 100.

The second coil 130 is wound both around the first side section 111 and around the second side section 113 of the elongated magnetic core 110, and which includes a jump portion (as indicated by the reference numeral 131 in FIG. 2) to jump over the first coil 120 wound on the middle section 112. The two terminals 130*a*, 130*b* of the second coil 130 are arranged on opposite ends of the elongated magnetic core 110. In this embodiment of the invention, the second coil 130 is used as the secondary winding of the transformer of the invention 100.

When the transformer of the invention 100 is integrated to the HID lamp ignitor shown in FIG. 1, the terminals 120*a*, 120*b* of the first coil 120 are used to receive the low voltage input VL1, while the terminals 130*a*, 130*b* of the second coil 130 are used to generate the high voltage output VL2 to the HID lamp 10.

Since the first coil (primary winding) 120 is arranged at the middle section 112 while the second coil (secondary winding) 130 is arranged at the first side section 111 and second side section 113 on both sides of the first coil 120, it allows the magnetic flux generated by the first coil 120 to induce the second coil 130 more effectively, i.e., it allows the first coil 120 and the second coil 130 to have an increased coupling efficiency. In addition, since the elongated magnetic core 110 is made of a magnetic material having a substantially square hysteresis loop and whose saturated flux density is at least two times greater than ferrite, it allows a better voltage transforming effect than prior art.

Figure 4A:
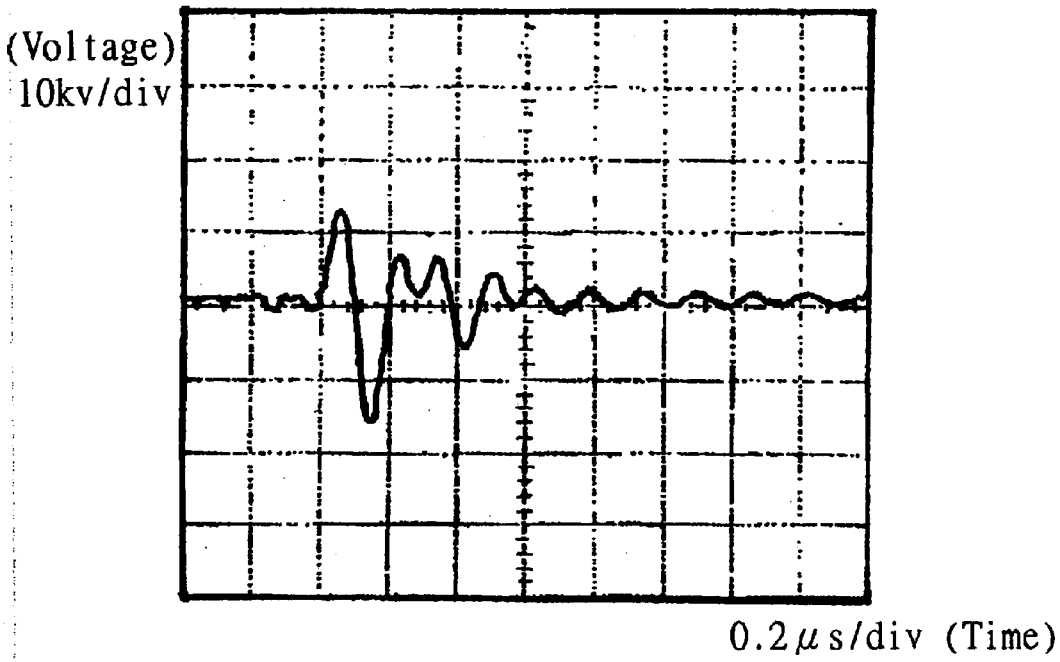
FIG. 4A is a waveform diagram showing the output pulsed voltage from the transformer of the invention.
Figure 4B:
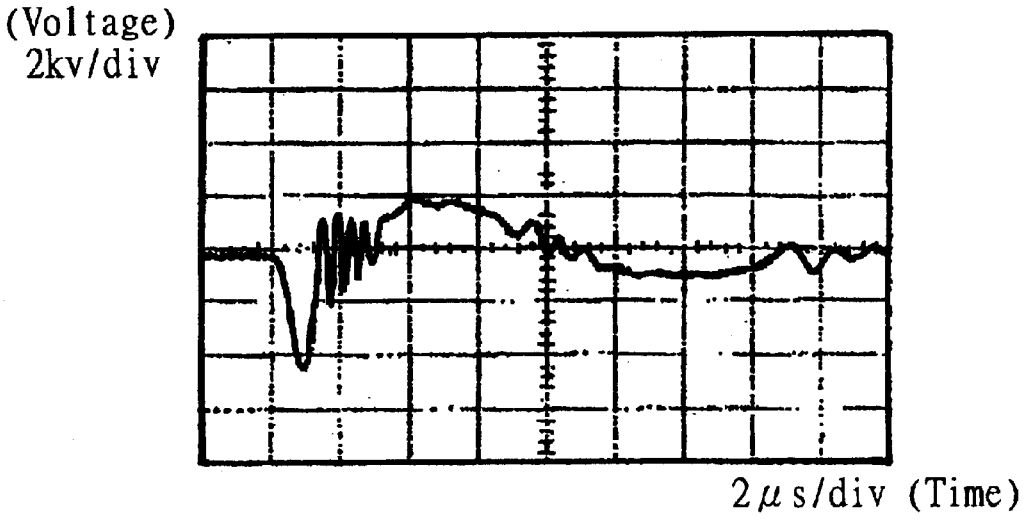
FIG. 4B (PRIOR ART)
FIG. 4B (PRIOR ART) is a waveform diagram showing the output pulsed voltage from a conventional transformer.

FIG. 4A is a waveform diagram showing the output pulsed voltage VL2 from the transformer of the invention 100; and FIG. 4B shows the output pulsed voltage from a conventional transformer. By comparing FIG. 4A to FIG. 4B, it can be seen that the output pulsed voltage from the transformer of the invention 100 is better than conventional transformer, which would more quickly and effectively ignite the HID lamp 10 than prior art.

In addition to the forgoing benefit, the transformer of the invention 100 is also more advantageous in size than prior art, since the invention utilizes an elongated magnetic core to wind both the first coil and the second coil, without having to utilize a large-size frame as in the case of many conventional transformers. This feature allows the transformer of the invention 100 to be made more flatted in profile, and therefore allow the transformer to be made more compact in size than prior art. This benefit allows the transformer of the invention to be highly competitive on the market.

In conclusion, the invention provides a flat high-voltage impulse transformer, which is characterized by the use of an elongated magnetic core that is made of a magnetic material having a substantially square hysteresis loop and whose saturated flux density is at least two times greater than ferrite, and the primary winding is arranged at the middle section of the elongated magnetic core while the secondary winding is arranged at opposite sides of the primary winding on the elongated magnetic core. This feature allows the transformer of the invention to provide a better voltage transforming effect, and also allows the transformer of the invention to be made more flatted in profile to provide a compact size. The invention is therefore more advantageous to use than the prior art. The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A flat high-voltage impulse transformer, which comprises:

an elongated magnetic core, which is made of a magnetic material having a substantially squarely-shaped hysteresis loop and whose saturated flux density is at least two times greater than ferrite; the elongated magnetic core being partitioned into a first side section, a middle section, and a second side section;

a first coil, which is wound on the middle section of the elongated magnetic core, and which has two terminals arranged at opposite ends of the middle section of the elongated magnetic core; and a second coil, which is wound on the first side section and the second side section of the elongated magnetic core on both sides of the first coil, with a jump portion jumping over the first coil on the middle section of the elongated magnetic core, and which has two terminals arranged at opposite ends of the elongated magnetic core.

2. The flat high-voltage impulse transformer of claim 1, wherein the elongated magnetic core is made of silicon steel.

3. The flat high-voltage impulse transformer of claim 1, wherein the elongated magnetic core is made of nickel steel.

4. The flat high-voltage impulse transformer of claim 1, wherein the elongated magnetic core is made of a cobalt-ferrite alloy.

5. The flat high-voltage impulse transformer of claim 1, wherein the elongated magnetic core is made of an amorphous alloy.

6. The flat high-voltage impulse transformer of claim 1, wherein the elongated magnetic core is rectangularly-shaped.

7. The flat high-voltage impulse transformer of claim 1, wherein the elongated magnetic core is cylindrically-shaped.

8. The flat high-voltage impulse transformer of claim 1, wherein the terminals of the first coil are used as voltage input terminals, while the terminals of the second coil are used as voltage output terminals.

* * * * *